US007271687B2

(12) United States Patent
Jedrzejewski et al.

(10) Patent No.: US 7,271,687 B2
(45) Date of Patent: Sep. 18, 2007

(54) DIELECTRIC RESONATOR HAVING A NON-UNIFORM EFFECTIVE DIELECTRIC PERMITTIVITY ALONG AN AXIS OF TUNER DISPLACEMENT

(75) Inventors: Piotr Jedrzejewski, Solna (SE); Christer Ahlberg, Kolbäck (SE); Uno Henningsson, Haninge (SE)

(73) Assignee: Telefonktiebolaget LM Ericsson (publ), Stockholm (SE)

( * ) Notice: Subject to any disclaimer, the term of this patent is extended or adjusted under 35 U.S.C. 154(b) by 102 days.

(21) Appl. No.: 10/536,616

(22) PCT Filed: Dec. 23, 2002

(86) PCT No.: PCT/SE02/02451

§ 371 (c)(1),
(2), (4) Date: May 26, 2005

(87) PCT Pub. No.: WO2004/057696

PCT Pub. Date: Jul. 8, 2004

(65) Prior Publication Data

US 2006/0145788 A1 Jul. 6, 2006

(51) Int. Cl.
*H01P 7/00* (2006.01)
*H01P 7/10* (2006.01)
*H01P 7/04* (2006.01)

(52) U.S. Cl. ..... 333/235; 333/209; 333/219.1; 333/224; 333/232

(58) Field of Classification Search ..... 333/235, 333/219.1, 219, 223, 224, 226, 231, 232, 333/209

See application file for complete search history.

(56) References Cited

U.S. PATENT DOCUMENTS

| | | | | |
|---|---|---|---|---|
| 5,049,842 | A * | 9/1991 | Ishikawa et al. | 333/235 |
| 5,712,606 | A * | 1/1998 | Sarkka | 333/219.1 |
| 6,262,639 | B1 * | 7/2001 | Shu et al. | 333/202 |
| 6,778,042 | B2 * | 8/2004 | Terashima et al. | 333/205 |

FOREIGN PATENT DOCUMENTS

| | | | |
|---|---|---|---|
| JP | 20000101314 | A | 4/2000 |
| WO | WO9611510 | A1 | 4/1996 |
| WO | WO9910948 | A1 | 3/1999 |
| WO | WO9966585 | A2 | 12/1999 |

OTHER PUBLICATIONS

Tao Shen et al, Tunable Dielectric Resonators with Dielectric Tuning Disks in Cylindrical Enclosures, Microwave Theory and Techniques, IEEE Transactions on , vol. 3 Issue Dec. 2000, pp. 1441-1444, AN 6703859.

Swedish Patent Office, International Search Report for PCT/SE02/02451 dated Jul. 29, 2003.

* cited by examiner

*Primary Examiner*—Robert Pascal
*Assistant Examiner*—Kimberly Glenn
(74) *Attorney, Agent, or Firm*—Roger S. Burleigh

(57) ABSTRACT

The present invention relates to an improved tuning arrangement to linearise the sensitivity to frequency changes within a certain frequency range in response to tuner displacements relative to a resonator body. The tuning arrangement comprises a tuner and/or resonator having a non-uniform distribution of the effective dielectric permittivity along the axis of tuner displacement. The non-uniform distribution of the effective dielectric permittivity is realised by subdividing the tuner into an arbitrary number of sections, each of which distinguishable at least by their geometrical shape and the value and distribution of the dielectric coefficient $\in_r$.

12 Claims, 12 Drawing Sheets

DIELECTRIC RESONATOR HAVING A NON-UNIFORM EFFECTIVE DIELECTRIC PERMITTIVITY ALONG AN AXIS OF TUNER DISPLACEMENT

FIELD OF THE INVENTION

The present invention relates to an improved tuning arrangement for frequency tuning of dielectric resonators utilising, e.g., a $TE_{01\delta}$-mode or a modified $TE_{01\delta}$-mode.

BACKGROUND OF THE INVENTION

Filter units for combining signals in radio base stations are conventionally built up of various units. FIG. 1 shows an example of a combiner unit 10 that is arranged within a chassis 13 consisting of a resonator 15 and a tuner 14, which is movably arranged within said resonator 15. The tuner 14 is adjusted to a position relative to a resonator axis, in the figure denoted the z-axis, in order to achieve a certain resonator frequency. This adjustment is often performed by means of a motor unit 11 and a threaded shaft 12 that is connected to said motor unit 11 and inserted into a threaded hollowness of the tuner 14 or other wise connected to it such that the radial movement of the shaft 12, which is caused by the motor unit 11, can be transformed into a linear movement of the tuner 14 along said resonator axis. This arrangement, however, achieves a non-linear frequency tuning and provides insufficient precision for frequency adjustments.

A tuning arrangement according to the state of the art may consists of a resonator 15 of a first dielectric material comprising a hollowness within which a tuner 14 of cylindrical shape and consisting of a second dielectric material can be inserted. The tuner 14 is movable arranged along an axis 12 of displacement, in this example z-axis, and can be moved within a range from a first position that corresponds to a maximum insertion into the hollowness of the resonator 15 to a second position where the tuner has been completely protruded out of said resonator. For the sake of simplicity, tuner movements are only considered in direction of the positive z-axis. However, it is apparent that is would be likewise possible to adjust the resonator frequency for tuner movements in the opposite direction.

FIG. 2 illustrates a sketch of the distribution of the electrical field for a $TE_{01\delta}$-mode in a resonator 31 comprising a hollowness 32 within which a tuner could be inserted. It can be observed that the field strength in the resonator hollowness is relatively weak; hence the perturbation of the field in the hollowness allows a tuning of the resonator frequency in a selected band. The resonator frequency depends on the dielectric properties of the building block consisting of resonator and tuner, in particular on the choice of the dielectric materials and the amount of the tuner mass that is interposed in the resonator hollowness. Frequency adjustments are achieved by varying the amount of dielectric material within the resonator hollowness. The main influence results from the resonator while the variation of the tuner position is applied for precision adjustments of the desired resonator frequency. For instance, each tuner position within the resonator implies a certain amount of dielectric material in the resonator hollowness and corresponds thus to a certain resonator frequency. The size of the frequency change depends on the amount and the dielectric properties of the protruded part of the tuner. The resonator frequency increases as long as the tuner is protruded out of the resonator hollowness within the tuning area.

A known system for tuning high-frequency dielectric resonators has been presented in EP 0 492 304. Said system comprises a male dielectric resonator having an external diameter d that penetrates to a certain degree p into a female dielectric resonator having an external diameter D. U.S. Pat. No. 4,728,913 shows another dielectric resonator which is capable of adjusting the dielectric resonator frequency through a wider frequency range without deteriorating $Q_0$.

SUMMARY OF THE INVENTION

In tuning arrangements according to the state of the art, a certain displacement of the tuner from a position relative to the resonator does not cause the same change of the resonator frequency for each of the possible tuner positions.

It has thus been observed to be a problem that the precision of an adjustment of the resonator frequency in such tuning arrangements is different for each of the various possible resonator frequencies, i.e. tuner positions.

Therefore, it is the overall object of the present invention to achieve a tuning arrangement that can be modified in such a way that the resonator frequency versus tuner position characteristic is adjusted to a desired form for a selected frequency band.

In particular, it is an object of the present invention to achieve a tuning arrangement comprising at least one tuner part and at least one resonator part wherein a displacement of the tuner along its axis of displacement results in almost proportional changes of the resonator frequency for a selected range of the possible tuner positions corresponding to the various resonator frequencies.

Briefly, the present invention bases on the insight that non-linear changes of the resonator frequency can be equalised or intensified by a non-uniform distribution of the dielectric properties of the tuner and/or resonator along the axis of tuner displacement. This is put into practice by means of subdividing the tuner and/or the resonator into sections whereby the non-uniform distribution of the dielectric properties is achieved by means of modifying the shape and/or dielectric permittivity $\in_r$ of the applied material for selected sections of the tuner and/or the resonator.

It is a first advantage of the tuning arrangement according to the present invention that the tuning precision for the resonator frequency can be adjusted to be almost constant for the selected frequency range.

It is another advantage that the tuning arrangement according to the present invention implies fewer demands on the mechanical construction of the parts of the tuning arrangement.

The invention will now be described in more detail by help of preferred embodiments and with reference to the accompanying drawings.

DETAILED DESCRIPTION

Figure 10A:
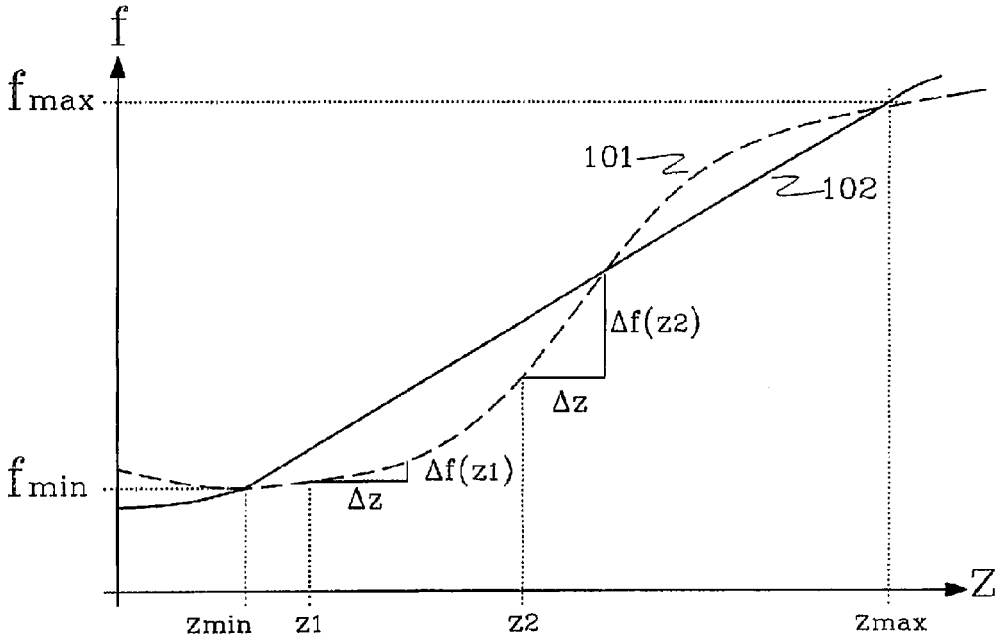
FIGS. 10*a* and 10*b* show frequency curves for the relation between tuner position and resonator frequency of a tuning arrangement according to the state of the art compared to the curves for two embodiments of the present invention.
Figure 10B:
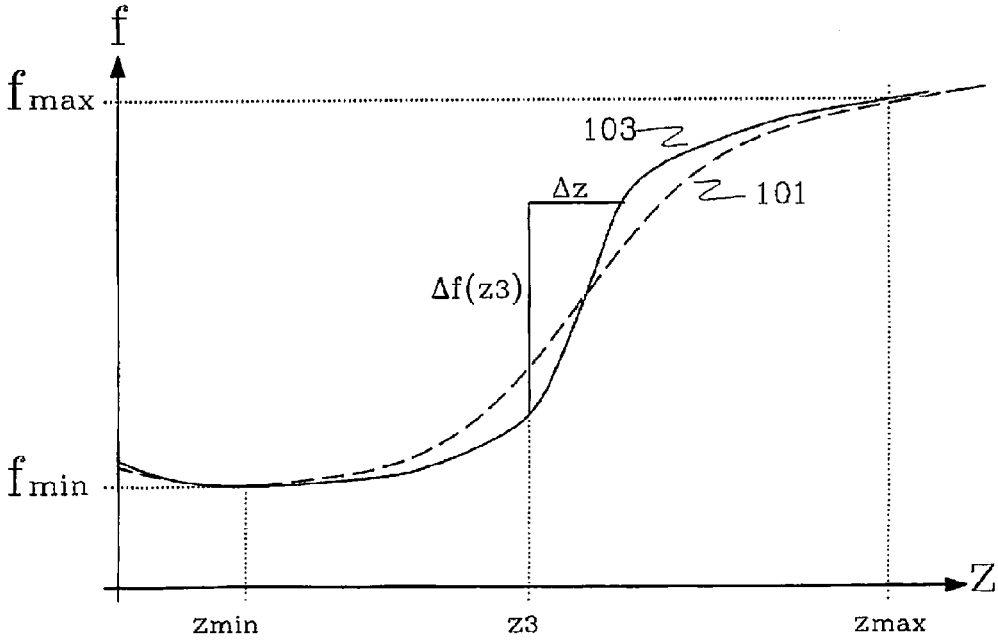

The tuning arrangement according to the present invention intends to achieve an adjustable sensitivity to changes $\Delta z$ of the tuner position from various starting points $z_i$ (i=1, 2, . . . ) with regard to the resulting changes $\Delta f(z_i)$ of the resonator frequency f. As indicated in FIGS. 10*a* and 10*b* the sensitivity s and its dependency on the tuner position $z_i$ can be represented by the inclination of the curve of the resonator frequency f with respect to the tuner position $z_i$ within the tuned bandwidth $[f_{min};f_{max}]$, i.e.

$$s = \frac{df}{dz}(z)\Big|_{z=z_i}.$$

The description of the present invention refers mainly to a tuning arrangement for a $TE_{01\delta}$-mode or modifications thereof. However, it is notwithstanding possible to apply the principles of the present invention also for other modes existing in the arrangement.

The preferred embodiments of the present invention can be realised by means of several alternatives that intend to achieve an almost linear dependency within a selected frequency range, i.e. an almost constant sensitivity within the tuned bandwidth $[f_{min};f_{max}]$, between a change $\Delta z$ of the tuner position along an axis of displacement and the corresponding frequency change $\Delta f$. The curve 102 in FIG. 10*a* illustrates an example where said linear dependency shall be achieved over the entire tuneable frequency range while the curve 103 in FIG. 10*b* relates to a case where said sensitivity shall be selectively increased for tuner positions that correspond to a distinct frequency range $\Delta f$ within the tuned bandwidth.

As illustrated by the first frequency curve 101 in FIGS. 10*a* and 10*b* a tuning arrangement according to the state of the art has a low sensitivity to frequency changes $\Delta f(z_i)$ for resonator frequencies corresponding to tuner positions, e.g. $z_1$, that are close to $z=z_{min}$, i.e. a major part of the tuner is still inserted within the resonator. However, this sensitivity becomes comparatively much higher for resonator frequencies that correspond to tuner positions, e.g. $z_2$, where the tuner has been partly removed from said resonator, i.e. for larger values of z. Therefore, the basic form of the preferred embodiment according to the present invention is a tuner or resonator where a tuner displacement causes in an initial phase a faster decrease of the total dielectric properties than in a later phase when, e.g., a part of the tuner already has been protruded from said hollowness. This is achieved by a tuner or resonator comprising a non-uniform distribution of the volume and/or the dielectric permittivity along the z-axis. The non-linearity of the relation between tuner displacement $\Delta z$ and change of the resonator frequency $\Delta f(z_i)$, as demonstrated by the frequency curve 101, can thus be equalised by a non-uniform distribution of the dielectric properties of the tuner and/or resonator along the axis of tuner displacement.

Figure 1:
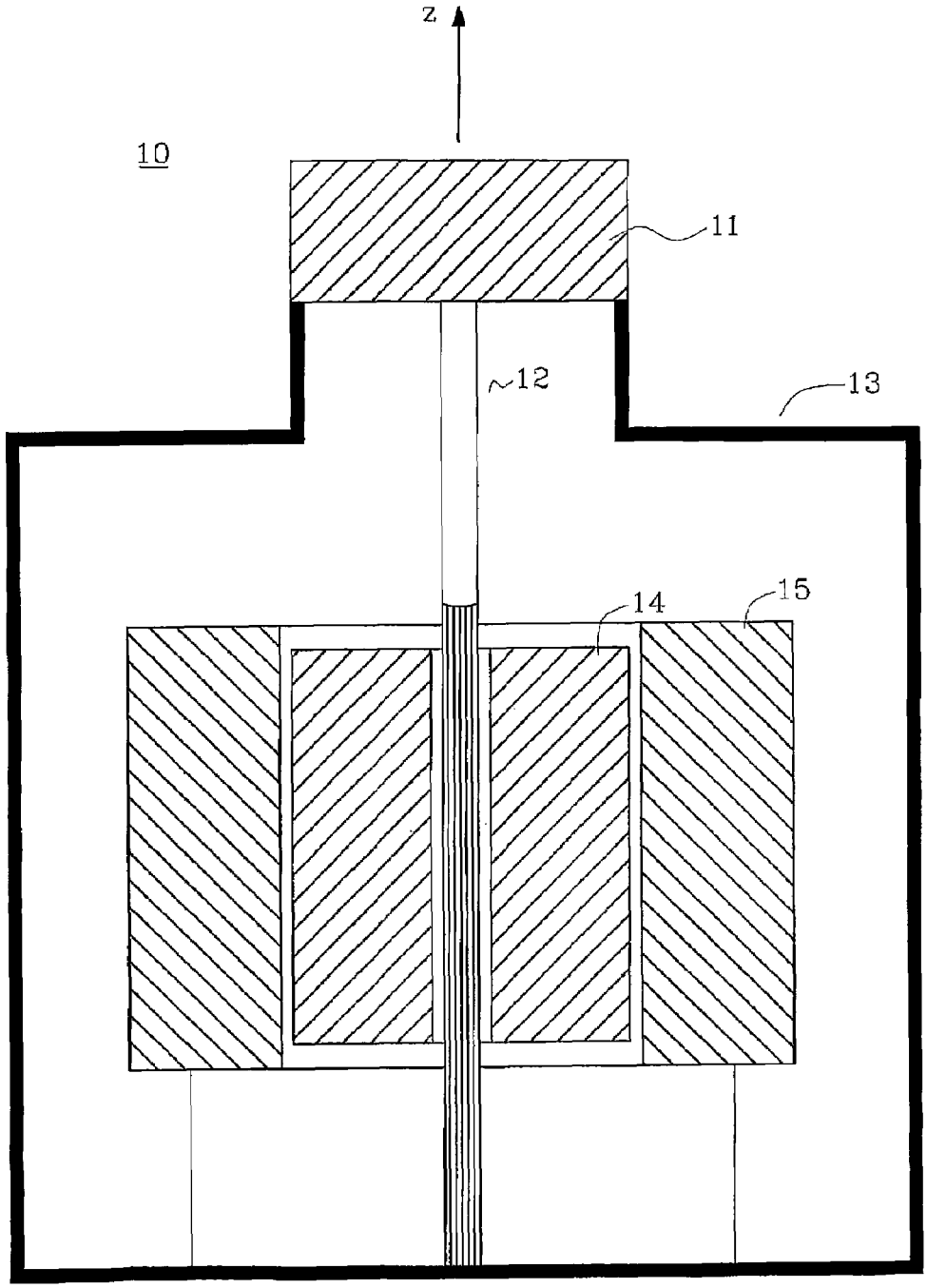
Fig. 1 (Prior Art)
FIG. 1 shows an arrangement within which the present invention can be applied comprising a resonator and a tuner according to the state of the art.
Figure 2:
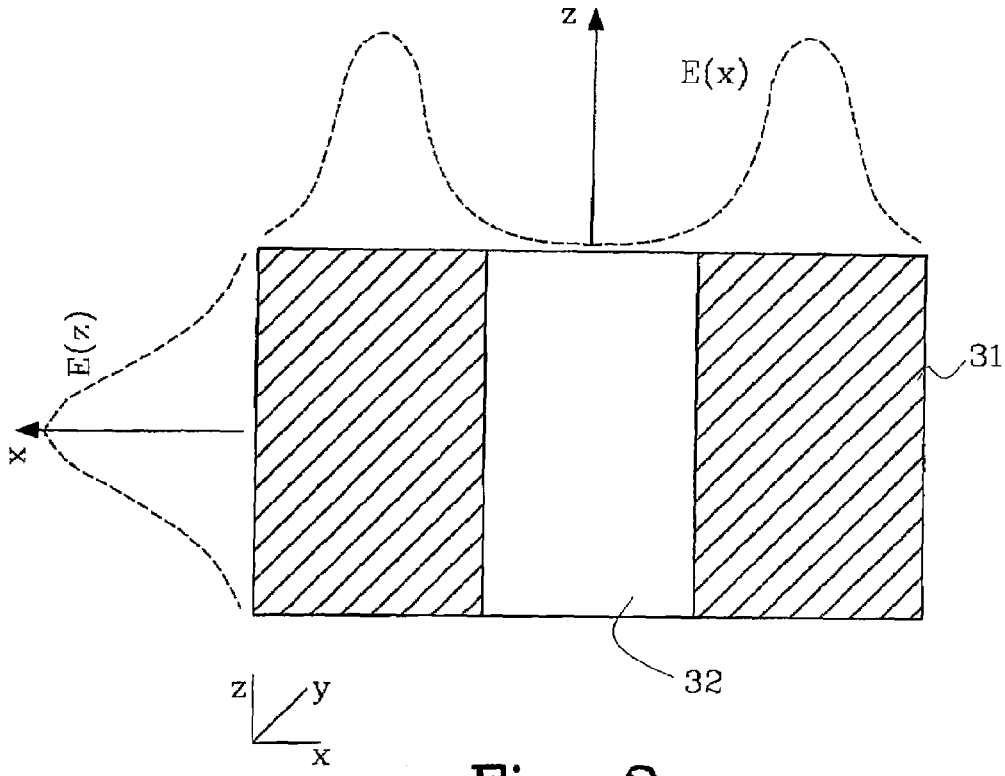
FIG. 2 shows the distribution of the electrical field in a resonator for a $TE_{01\delta}$-mode.
Figure 3A:
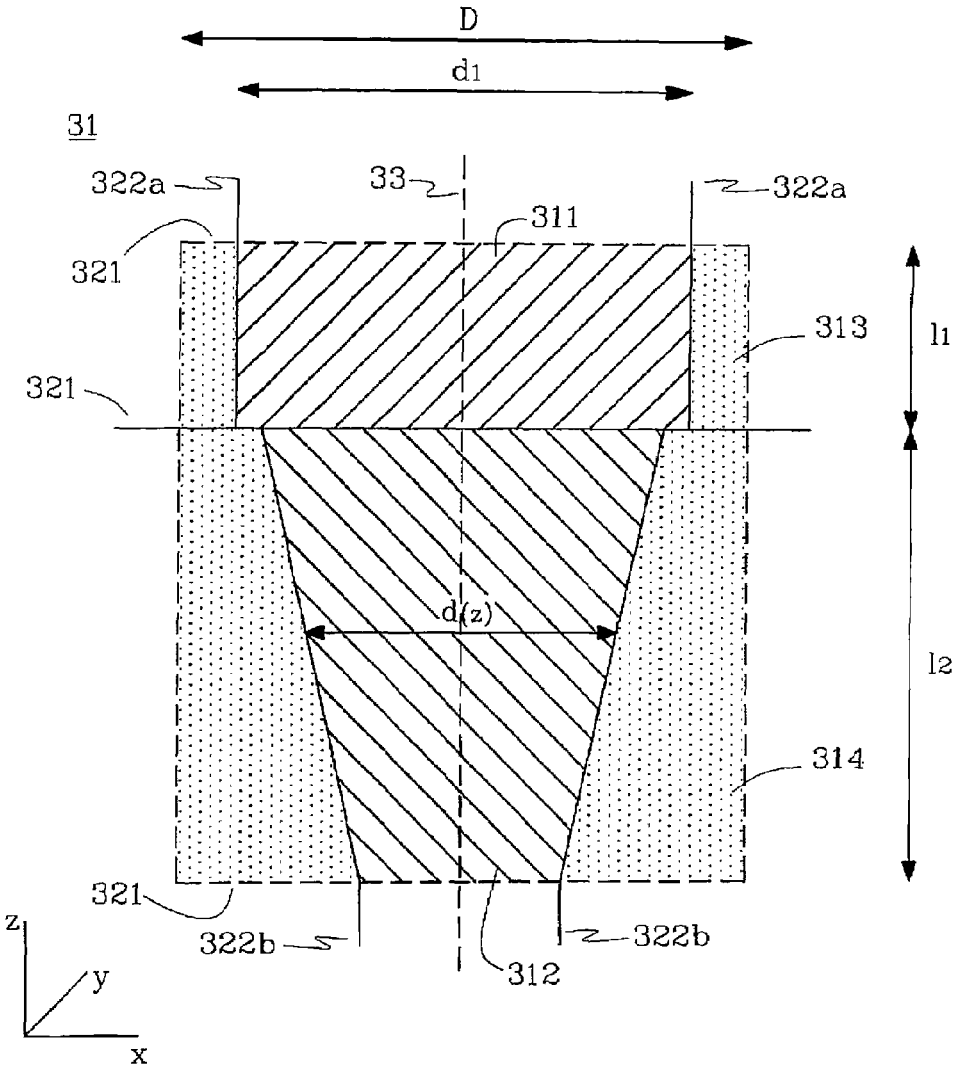
FIG. 3*a* shows an example of a general tuner structure and FIG. 3*b* shows an example of a general resonator structure according to the present invention.

FIG. 3*a* shows an example of a general embodiment of a tuner according to the present invention. The tuner can be assumed to be realised within an appropriate three-dimensional body 31, preferably of a form that is symmetric to its longitudinal z-axis 33, e.g. comprising a circular, trapezoidal, oval, quadratic or other cross sections not regular in shape. According to the basic idea of the present invention, the non-linear frequency changes in response to tuner displacements relative to a resonator body are equalised by means of a tuner comprising a non-uniform distribution of the dielectric properties along the axis of tuner displacement. Such a tuner object is formed by means of subdividing said body 31 into an arbitrary number of sections 311-314, each of which comprising certain dielectric properties, which is achieved by means of varying the volume and/or the dielectric permittivity $\in_r$ of said sections. The dielectric properties of such a tuner consisting of a number of sections can be described by help of the concept of an effective dielectric permittivity, which denotes the effective dielectric permittivity of various tuner portions, e.g. in direction of the tuner displacement, that are composed of one or more sections comprising different dielectric permittivities. An increased effective dielectric permittivity of a tuner portion causes thus an increased sensitivity to frequency changes while a comparatively lower effective dielectric permittivity of a tuner portion causes a decrease of the frequency sensitivity in respective tuner positions.

The various tuner sections are limited by means of surfaces that can be described by help of a set of three-dimensional functions $f_s(x,y,z)$. Here such functions denote the horizontal surfaces 321 and vertical surfaces 322*a*,322*b*. Additionally, each section 311-314 can further be described by means of a function for the distribution of the dielectric permittivity $\in_r(x,y,z)$. A section can, e.g., consist of a material having a homogeneous dielectric permittivity or comprise an increase or decrease of said permittivity towards a certain direction within the section. It is especially possible that certain sections 313,314 are air-filled, i.e. $\in_r \approx 1$. The material used to build a section is characterised here for simplicity by its real part $\in_r$ of complex relative permittivity. But in general, material properties are characterised by the complex permittivity $\in_c = \in' - j\in''$ where $\in' = \in_r * \in_0$, $\in'' = \sigma/\omega$, $\sigma$ is material conductivity and $\omega$ angular frequency. This description allows one to classify a material as almost perfect or good dielectric when $\sigma/\omega\in' \ll 1$ or as a good conductor when $\sigma/\omega\in' \gg 1$ is valid. However, in certain cases one or several sections can be build of materials regarded as almost perfect or good conductors i.e. materials for which only the imaginary part of $\in_c$ exist i.e. $\in'' = \sigma/\omega$ and these materials are usually characterised by the value of material conductivity $\sigma$ at certain frequency.

In some cases the functions describing the section surfaces $f_s(x,y,z)$ and the distribution of the dielectric permittivity $\in_r(x,y,z)$ in the sections can be easier presented in other coordinate system than the rectangular x,y,z coordinate system used in this application, e.g cylindrical coordinate system.

The example shown in FIG. 3*a* shows a tuner 31 that is symmetric to a certain z-axis and built up of sections having a cylindrical, conical or ring form. The tuner consists of two portions whereof each portion in its turn is subdivided into two sections. The sections are horizontally subdivided by a planar surface 321 and vertically subdivided by a surface 322*a* that comprises a cylindrical surface of length $l_1$ and diameter $d_1$ for the upper tuner portion and a conical surface 322*b* of length $l_2$ and a variable diameter d(z) for the lower tuner portion. The upper tuner portion comprises thus an inner tuner section 311 of a material having a first dielectric permittivity $\in_{r1}$ and a ring-shaped outer tuner section 313, which in this example concentrically surrounds said inner tuner section and consists of a material having a dielectric permittivity $\in_{r2}$, e.g. air. Correspondingly, the lower tuner portion comprises a conical inner tuner section 312 of a material having a dielectric permittivity $\in_{r3}$ and a surrounding outer tuner section 314 having a dielectric permittivity $\in_{r4}$, e.g. air.

Figure 3B:
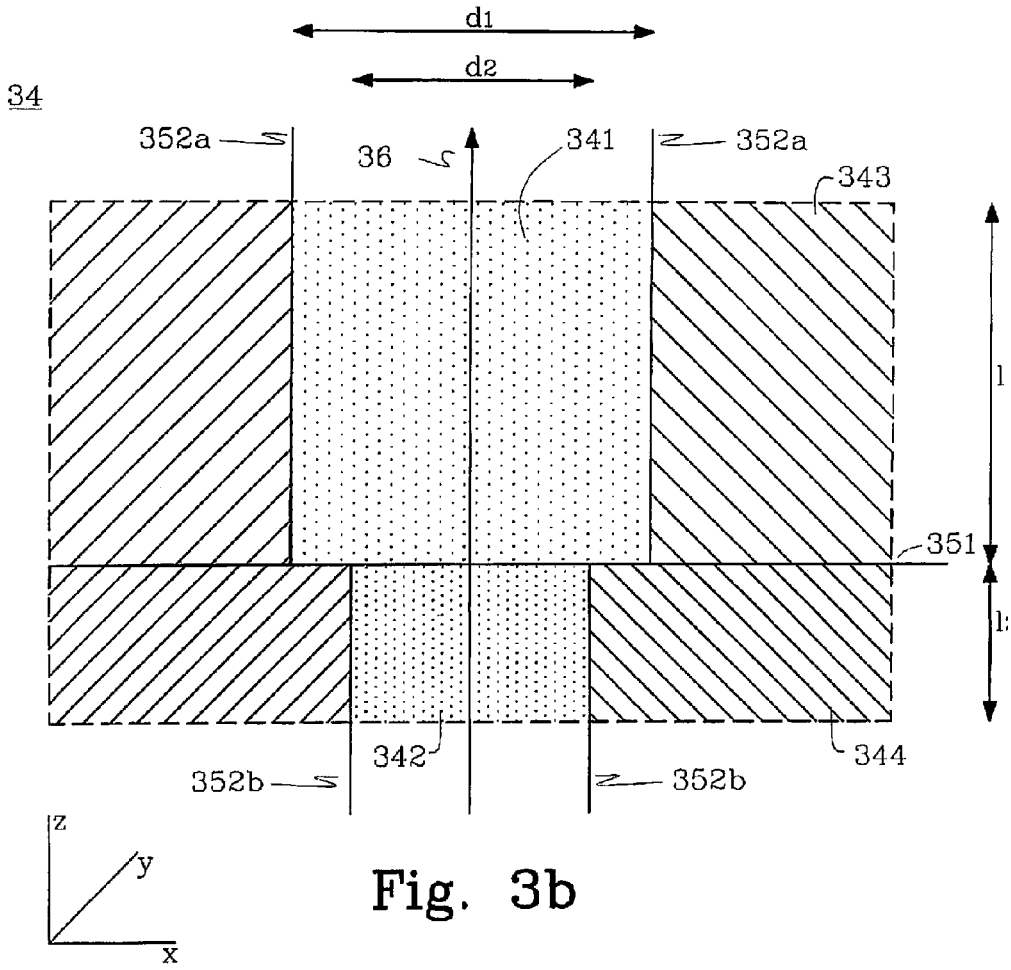

FIG. 3*b* shows a similar approach of a general embodiment of a resonator according to the present invention. Correspondingly to the tuner according to FIG. 3*a*, the resonator is considered as a building block consisting of an appropriate number of sections 341-344 characterised by means of their geometry, e.g. diameter, thickness, and length, and by means of the distribution of the dielectric permittivity $\in_r(x,y,z)$ of the material that is applied for said sections. As for the tuner object, the sections are defined by help of sets of three-dimensional functions $f_s(x,y,z)$ that denote the horizontal surfaces 351 and the vertical surfaces 352*a*,352*b* of the sections, whereby each section can be further described by means of a distribution function of the dielectric permittivity $\in_r(x,y,z)$.

As an example, the resonator shown in FIG. 3*b* is built up of sections 341-344 having a cylindrical or ring form. The sections are horizontally separated by a planar surface 351 and vertically separated by a surface 352*a* having a cylindrical surface of length $l_1$ and diameter $d_1$ for the upper resonator portion and a cylindrical surface 352*b* of length $l_2$ and diameter $d_2$ for the lower resonator portion. The upper resonator portion comprises thus an inner section 341 of a material having a first dielectric permittivity $\in_{r1}$ and an outer resonator section 343 of a material having a second dielectric permittivity $\in_{r2}$. When assuming a tuning arrangement where the tuner is inserted in a resonator hollowness at least one of the inner resonator sections 341 is air-filled, i.e. $\in_{r1}\approx 1$. For embodiments where the tuning is performed by a tuner that is placed outside of the resonator body said section can be filled out with an other appropriate dielectric material, i.e. $\in_{r1}>1$. Correspondingly, the lower resonator portion comprises two sections of dielectric permittivity $\in_{r3}$ and $\in_{r4}$, whereby the inner resonator section can be air-filled, i.e. $\in_{r3}\approx 1$, for embodiments that require a hollowness throughout the entire resonator body.

Within the scope of the present invention it is notwithstanding possible to design the tuner and/or the resonator with an arbitrary number of sections to achieve any desired shape and distribution of the dielectric permittivity within the material. However, for a tuner according to the present invention in general, the geometrical profile or distribution of the dielectric permittivity $\in_r$ along the axis of tuner displacement must be designed in such a way that the tuner portion comprising the largest effective permittivity is the portion that is first protruded out of the resonator or the portion which is located further with respect to the resonator body. Correspondingly, for the resonator the geometrical profile or the distribution of the dielectric permittivity of a resonator along the axis of tuner displacement must be designed in such a way that the tuner is first protruded out of the resonator portion that comprises the largest effective dielectric permittivity.

The two general embodiments shown in FIGS. 3*a* and 3*b* describe thus modifications, in regard to the conventional cylindrical structures, of a tuner or resonator with regard to their geometry or the dielectric properties of the applied material or a combination of these modifications. A change of the geometry implies thus a tuner or resonator comprising sections that are filled with a dielectric material and sections comprising materials having a lower relative permittivity, e.g. air $\in_r\approx 1$. A change of the dielectric material results in tuner or resonator arrangement which possess at least two portions with different relative dielectric permittivities. Other embodiments may apply changes of both the geometry and the dielectric permittivity. Further, it is notwithstanding possible to realise a tuning arrangement that applies all of the suggested modifications at the same time.

Figure 4A:
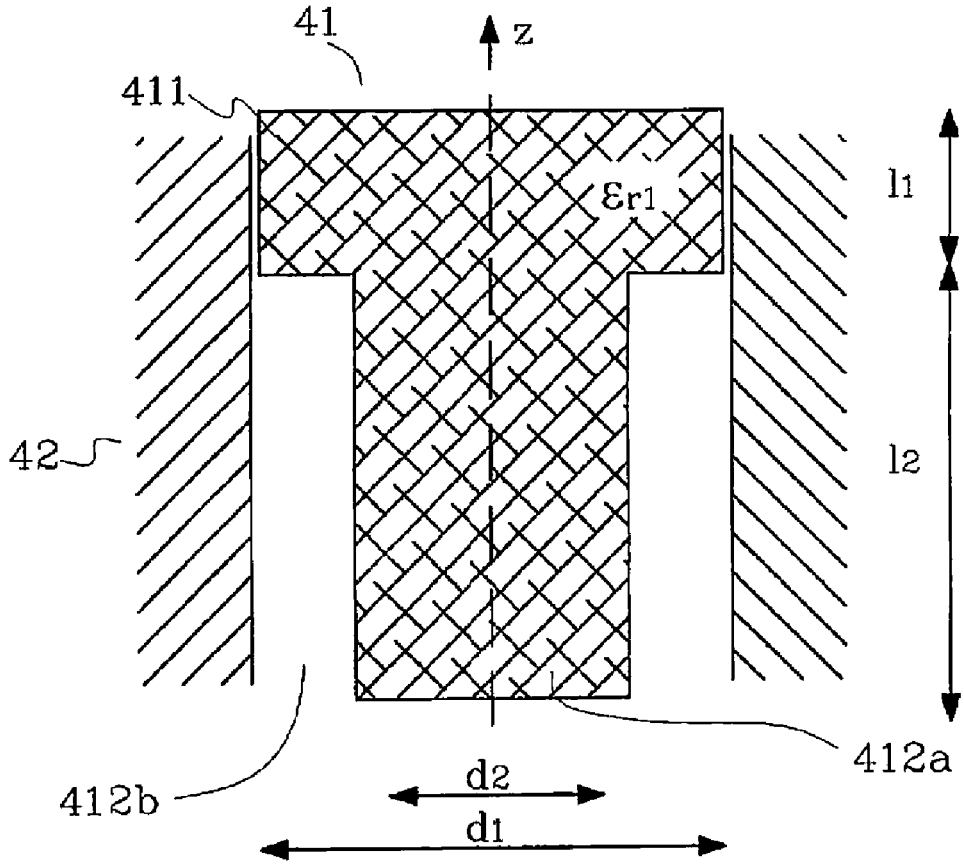
FIGS. 4*a*-4*c* show three embodiments of tuner object according to the present invention.
Figure 4B:
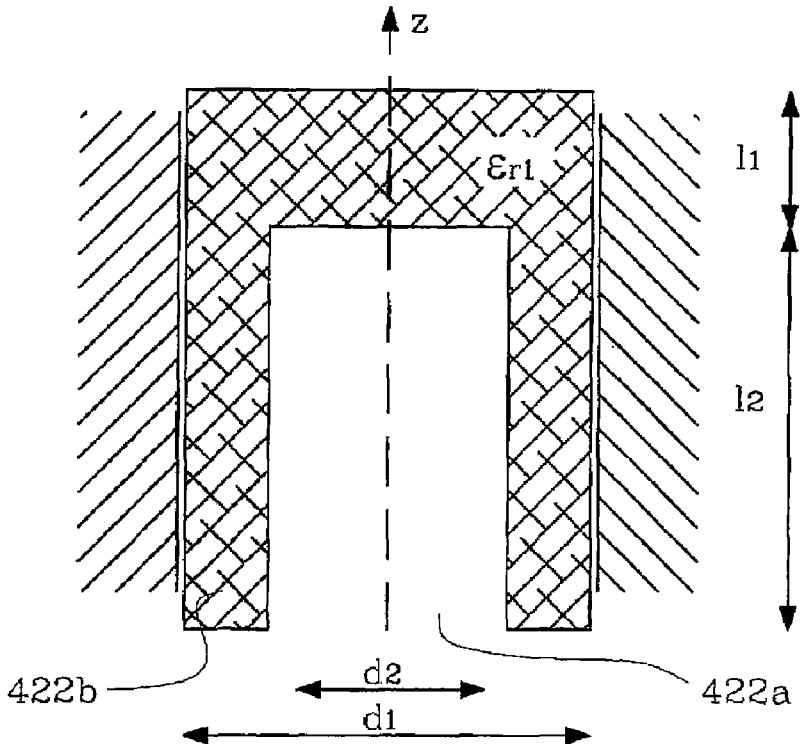
Figure 4C:
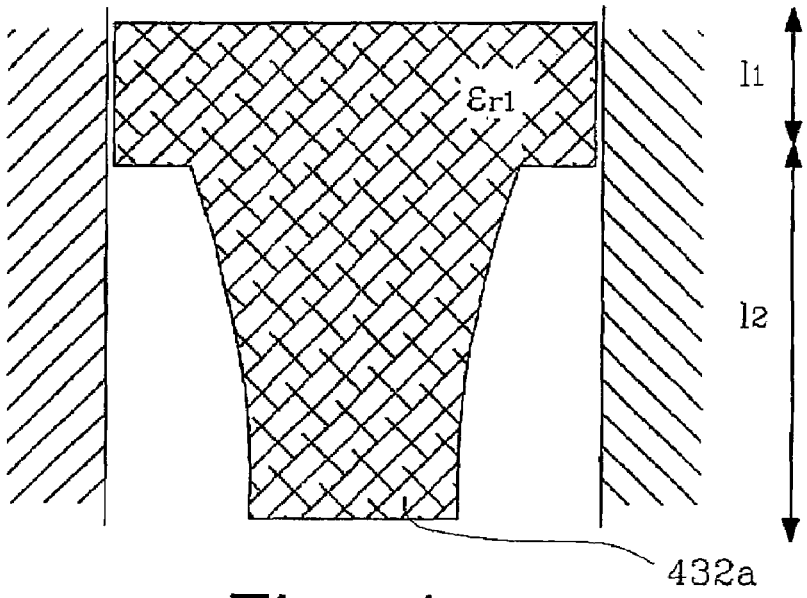

A first embodiment of the tuning arrangement according to the present invention relates to a cylindrical tuner 41 that is inserted into a hollowness of a resonator 42 and built up of sections of a material with dielectric coefficient $\in_{r1}$ or air-filled sections, i.e. sections comprising $\in_{r2}\approx 1$. The various alternatives of said first embodiment, as illustrated, e.g., in FIGS. 4*a*-4*c*, are distinguishable by means of the geometric profiles of the section boundaries. According to the first embodiment, as shown in FIG. 4*a*, the non-uniform distribution of the dielectric permittivity in the resonator hollowness depends on the non-uniform distribution of the dielectric material of the tuner 41. The upper tuner portion 411 comprises a higher amount of the tuner material per unit length, and thus a higher effective dielectric permittivity per volume unit, than the lower tuner portion, which includes a section 412*a* consisting of the tuner material and an air-filled section 412*b*. When the tuner 41 is protruded from a first position, which corresponds to a maximum insertion of the tuner within the resonator hollowness, out of said hollowness in direction of the positive z-axis the reduction of the tuner material from the resonator hollowness is higher approximately as long as the upper tuner portion 411 is protruded but will be comparatively lower for positions where only the lower tuner portion including the air-filled section 412*b* is protruded. Accordingly, the sensitivity to frequency changes is comparatively higher in the beginning and lower at the end of tuner movement that causes the mentioned above equalisation of the sensitivity. For the embodiment shown in FIG. 4*a*, it has turned out to be beneficial to select for a typical tuned frequency range between 0.4 GHz and 3 GHz and for typical resonator used in this band the ratio $d_1/d_2$ of the diameters of the cylindrical tuner from a range approximately between 1.1 and 1.6 and the ratio $l_1/l_2$ of the lengths of the corresponding tuner sections from a range approximately between 0.2 to 0.4.

According to another alternative of the first embodiment the solid cylindrical section 412*a* could be replaced by a ring-formed section 422*b*, as shown in FIG. 4*b*, such that an air-filled section 422*a* appears within said ring-shaped tuner section 422*b*. Both alternatives in FIGS. 4*a* and 4*b* apply a cylindrical boundary surface of a diameter $d_2$ and length $l_2$ for the lower tuner portion. Another alternative is a combination of embodiments shown on FIGS. 4*a* and 4*b* where the lower portion is composed of a ring section having two air sections located inside and outside of the ring section.

In other cases, as shown in FIG. 4*c*, the tuner sections can be subdivided by another appropriate three-dimensional surface, e.g., to achieve a conical like form of the inner section 432*a* of the lower tuner portion.

Figure 5A:
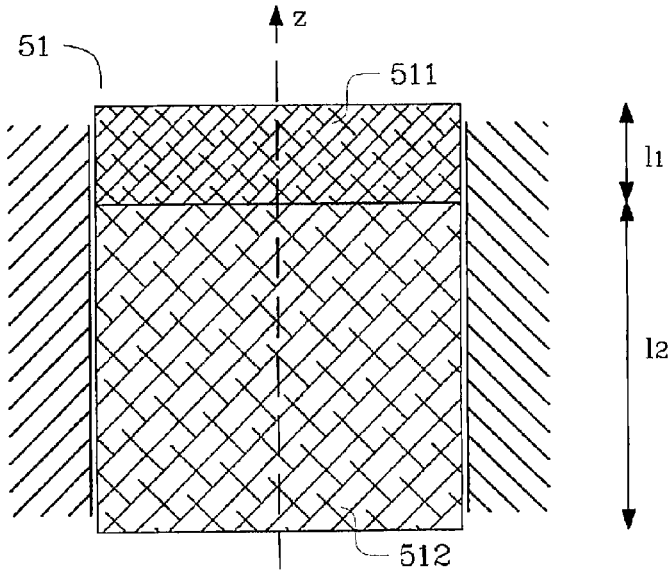
FIG. 5*a* shows a further embodiment of a tuner object according to the present invention.
Figure 5B:
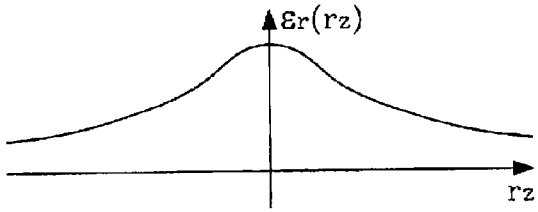
FIGS. 5*b* and 5*c* show two examples of a distribution of the dielectric permittivity in a tuner section.
Figure 5C:
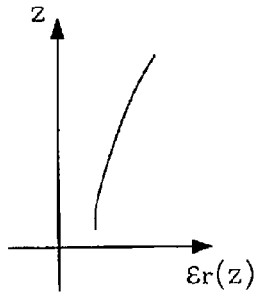

FIG. 5*a* shows another embodiment of the present invention to achieve a non-uniform distribution of the dielectric permittivity within the resonator hollowness, which is realised by a tuner 51 with two or more sections 511,512 each of which consisting of materials with a different dielectric permittivity $\in_{r1}$ and $\in_{r2}$ or characterised by a distribution function $\in_r(x,y,z)$ of said permittivity. The tuner sections are separated by surface 513 that in general can be described by a three dimensional function $f_s(x,y,z)$. The effective dielectric permittivity of the upper tuner section 511, which is protruded from the resonator hollowness in direction of the positive z-axis, must be higher than the effective dielectric permittivity of the lower tuner section 512. The non-uniform distribution along the z-axis is thus achieved by the choice of the dielectric permittivity instead of the geometric dimensioning. The distribution of the dielectric permittivity for each section can either be constant or, as illustrated in FIGS. 5*b* and 5*c*, described by help of a three-dimensional distribution function for $\in_r$. FIG. 5*b* illustrates a possible distribution for a tuner section for a certain radius $r_z$ of the xy-plane, i.e. for a constant value for z, where the permittivity is higher in the centre part of the tuner section compared to the outer section parts. FIG. 5*c* illustrates a corresponding curve for the dielectric permittivity in direction of the z-axis for a certain position $r_z$ in the xy-plane, which indicates an increase of the permittivity value in direction of the tuner displacement.

For an embodiment consisting of two sections with constant values for $\in_{r1}$ and $\in_{r2}$ and presuming a cylindrical tuner, as shown in FIG. 5*a*, that shall be applied for a typical tuned frequency range between 0.4 GHZ and 3 GHz and for a typical resonator structure used in this band the value of the dielectric permittivity $\in_{r1}$ is typically selected approximately three times higher than the value of the dielectric permittivity $\in_{r2}$, i.e. $\in_{r1}/\in_{r2}\approx 3$, while the ratio $l_1/l_2$ of the lengths of the corresponding tuner sections is selected from a range approximately between 0.2 to 0.4.

Figure 6A:
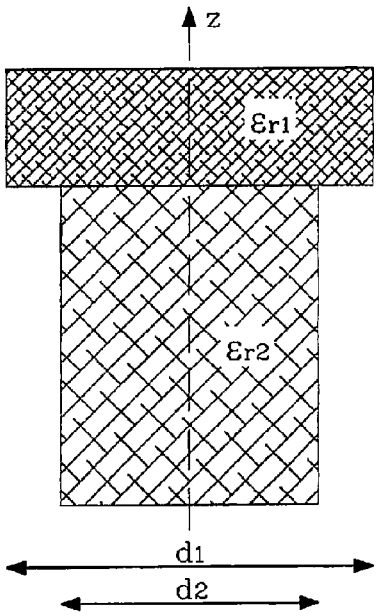
FIGS. 6*a*-6*c* show three embodiments of tuner objects coming from a combination of features of the first and second embodiment.
Figure 6B:
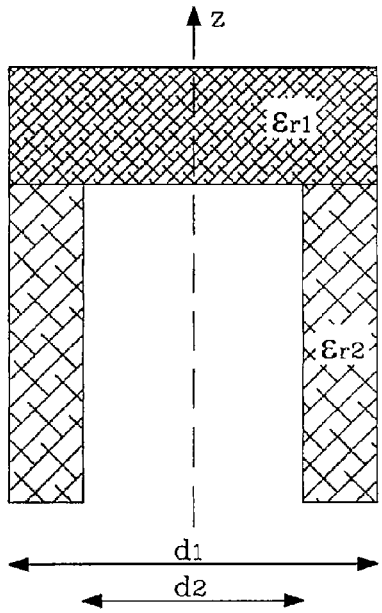
Figure 6C:
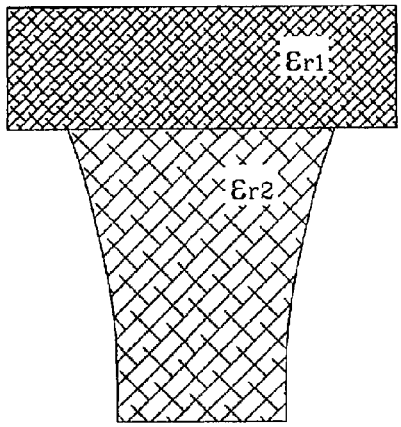

The embodiments presented in FIGS. 4*a*-4*c* and FIG. 5*a* achieve the non-uniform distribution of the effective dielectric permittivity by applying either a non-uniform distribution of the dielectric material along z-axis or a non-uniform distribution of the dielectric permittivity along the z-axis. However, it is straightforward to apply both non-uniform distributions of the dielectric material and dielectric permittivity in one tuner. This leads to other possible realisations of the tuner according to the present invention as shown, e.g., in FIGS. 6*a*-6*c*, which combine the characteristics of the embodiments shown in FIGS. 4*a*-4*c* and FIG. 5*a*.

In certain cases, the tuner embodiments described above can possess a preferably cylindrical hollowness along the z-axis, preferably in the centre of the tuner. Small modifications of the tuner dimensions are then required to compensate the lack of material in the hollowness but the main features of the tuner embodiments are still valid.

Figure 7A:
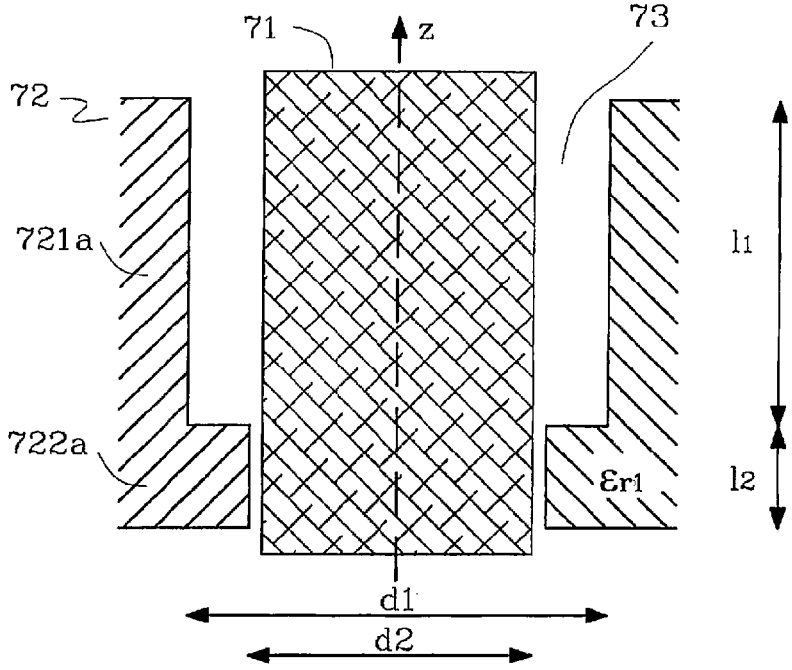
FIGS. 7*a* and 7*b* show still to further embodiments of a resonator object according to the present invention.
Figure 7B:
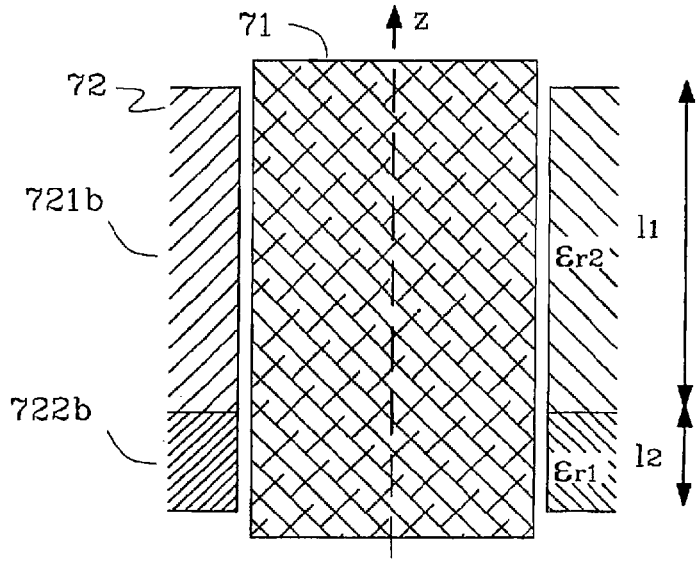

Two other conceivable embodiments realise the basic idea of the present invention by corresponding modifications of the resonator body 72, as shown in FIGS. 7*a* and 7*b*. Here, the tuner 71 constitutes, e.g., a cylindrical body or a tuner as described above that is inserted within the resonator 72. When said tuner 71 is completely inserted within the resonator hollowness and protruded out of said hollowness from this position, the sensitivity to frequency changes is comparatively higher as long as the tuner 71 is positioned between the first resonator section 722*a*,722*b* comprising the higher resonator volume per unit length along the axis of tuner displacement and/or consisting of a material of a higher dielectric coefficient $\in_{r2}$ while said sensitivity is comparatively lower when the tuner 71 is further protruded out of the resonator hollowness and positioned in the second resonator section 721*a*,721*b* consisting of a material of a dielectric coefficient $\in_{r1}$. As indicated above the non-uniform distribution along the z-axis can be achieved either by means of varying the geometrical dimensions of the resonator hollowness or by means of applying dielectric materials comprising different dielectric coefficients $\in_r$. The embodiment as shown in FIG. 7*a* refers to a resonator hollowness comprising a first section 722*a* of a narrower diameter $d_2$ in order to increase the amount of dielectric material per unit length and a second section 721*a* with a resonator hollowness of a larger diameter $d_1$ such that there is an additional section of different dielectric permittivity, in the figure realised by an air-filled space 73. A change of the effective dielectric permittivity of a resonator portion can also be achieved by means of adding or removing resonator material at the resonator outside or at both the resonator inside and outside.

Regarding the embodiment shown in FIG. 7*a* and presuming a typical tuned frequency range between 0.4 GHZ and 3 GHz and the typical resonator form used in that band the ratio $d_1/d_2$ for the diameters of the resonator hollowness for each section can be selected from a range between 1.1 and 2.0 and the ratio $l_1/l_2$ for the corresponding lengths of said sections can be selected from a range between 1.5 and 4.5. Correspondingly, the alternative as shown in FIG. 7*b* refers to a resonator comprising a first section 722*b* of a dielectric material having a value for the dielectric coefficient $\in_{r1}$ that is higher than the value for the dielectric coefficient $\in_{r2}$ of a second section 721*b* consisting of a second dielectric material. For this embodiment and presuming a tuned frequency range between 0.4 GHZ and 3 GHz and the typical resonator form used in that band the ratio $\in_{r1}/\in_{r2}\approx 2$ and the ratio $l_1/l_2$ for the corresponding lengths of said sections can be selected from a range between 1.5 and 4.5.

Figure 8A:
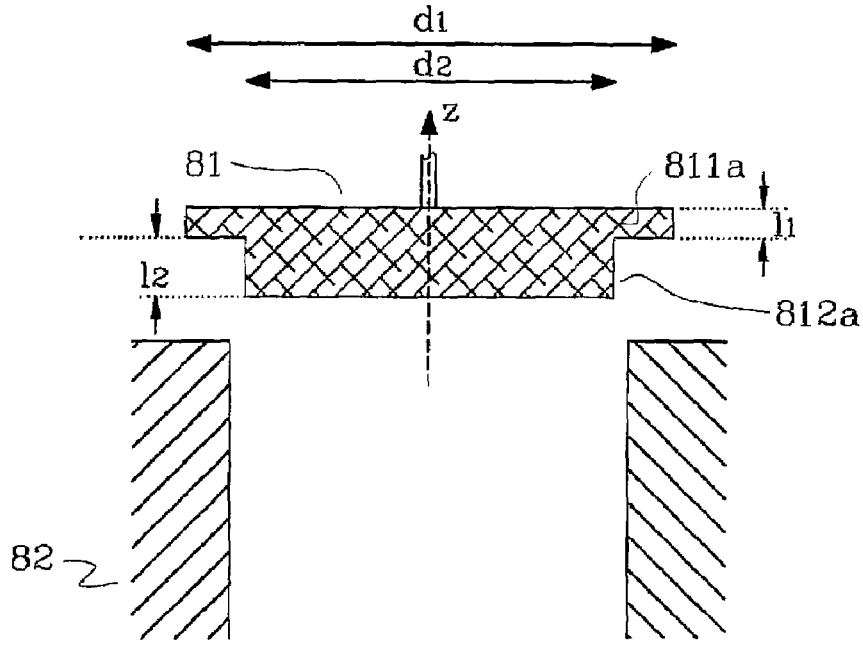
FIGS. 8*a*-8*c* show three embodiments of a tuner object according to the present invention comprising tuner objects that are arranged outside of the resonator.
Figure 8B:
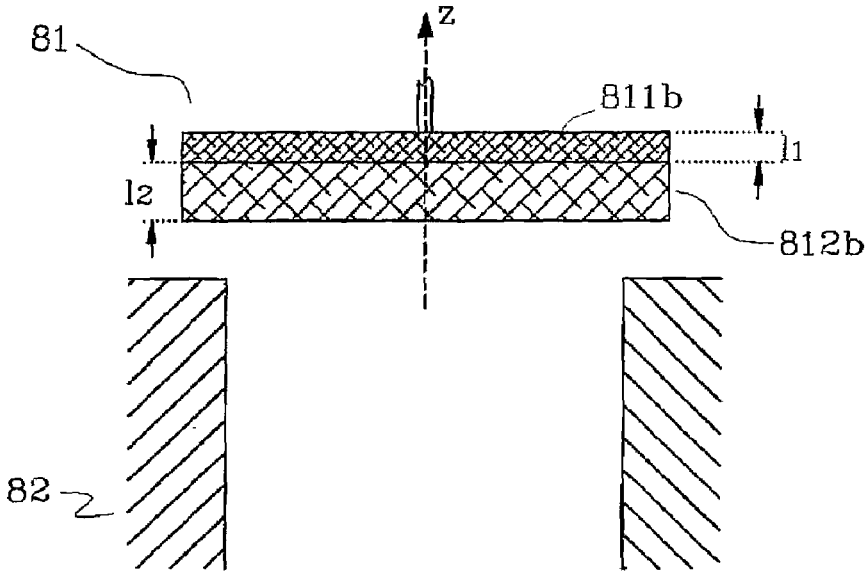
Figure 8C:
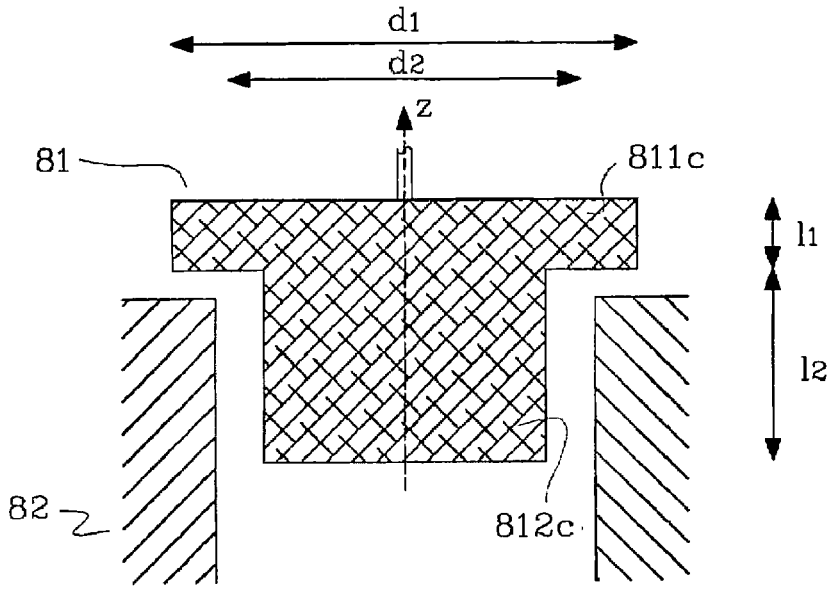

Still three other embodiments of the present invention relate to a tuning element 81 that is placed outside the of the resonator hollowness as shown in FIG. 8*a* and FIG. 8*b* or partly inserted as shown in FIG. 8*c*. As explained above, the tuner is applied for a fine-tuning of the resonator frequency by means of affecting the electrical field within the resonator. In the embodiments shown in FIGS. 8*a* and 8*b* the tuner 81 affects instead the electrical field outside of the resonator. Although the frequency curve in these cases has a slightly different shape when compared to curve 101 in FIG. 10*a* the main idea of the invention is valid and can be described as follows. As already mentioned above, changes of the tuner position result in different changes of the resonator frequency depending on the starting position of the tuner. In order to make this dependency more linear, the tuner 81 is built up of two or more sections that can be distinguished at least by means of their geometrical dimensions and/or dielectric coefficient. The example in FIG. 8*a* shows a tuner 81 comprising a first section 811*a* of length $l_1$ and diameter $d_1$ and comprising a second section 812*a* of length $l_2$ and a diameter $d_2$, which is smaller than the diameter $d_1$. Correspondingly, the example in FIG. 8*b* shows a tuner 81 comprising a section 811*b* of a certain length $l_1$ that consist of a material having a first dielectric coefficient $\in_{r1}$ that is higher than the dielectric coefficient $\in_{r2}$ of the material of the second tuner section 812*b* of length $l_2$. The sections 812*a*, 812*b* comprising the smaller tuner volume per unit length along the axis of tuner displacement or a lower dielectric coefficient cause comparatively smaller changes of the resonator frequency compared to a tuning arrangement with a uniform distribution of mass and/or dielectric coefficient. The sensitivity to frequency changes is thus decreased for those tuner positions where such tuner sections 812*a*, 812*b* are effective which leads to a linearisation of the frequency curve.

A variant of the tuner embodiments, which is combination of the embodiments presented in FIGS. 8*a* and 4*a* is shown in FIG. 8*c*. In that case the tuner affects the fields inside the resonator hollowness and outside the resonator. The tuner is built up of two or more sections that are distinguished by their geometrical dimensions and/or dielectric permittivity. The section 812*c*, which is built up of a material having a dielectric coefficient $\in_{r1}$ has a smaller diameter $d_2$ than the section 811*c* having the larger diameter $d_1$ and consisting either of a similar material or a material having a higher dielectric coefficient $\in_{r2}$. Section 812*c* is inserted in the resonator hollowness at the beginning of the tuner movement. As for the structures shown in FIGS. 8*a* and 8*b* this tuner causes smaller changes of the resonator frequency at the beginning of the movement and make thus the frequency curve more linear.

Figure 9:
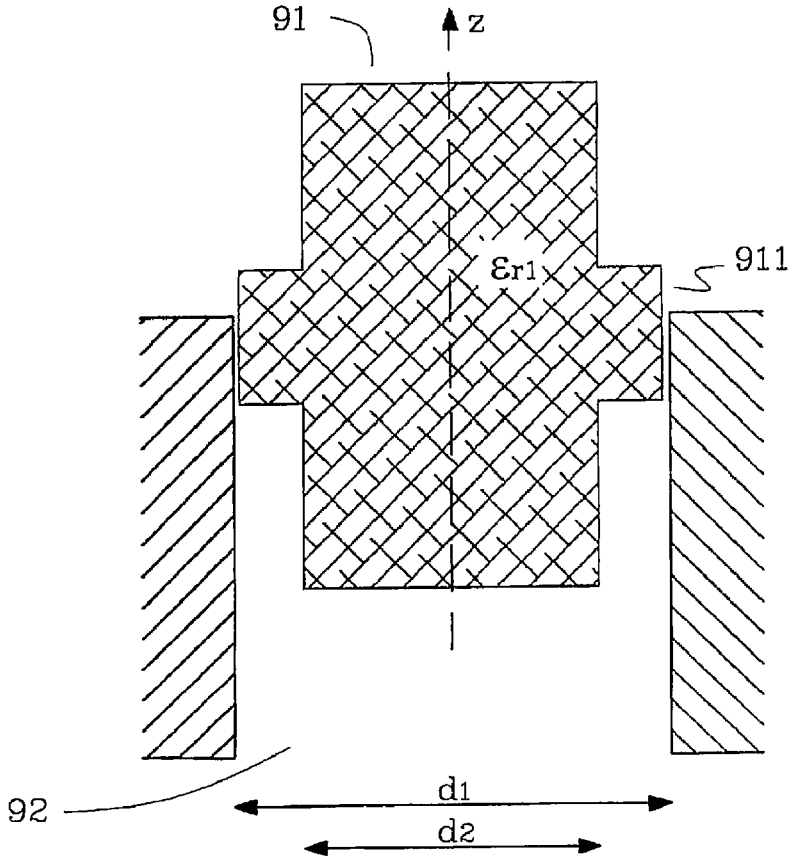
FIG. 9 shows an example of yet another embodiment of a tuner object according to the present invention.

The invention according to the embodiments and its alternatives as described above focuses on a linear dependency, i.e. a constant sensitivity, between changes of the tuner position $\Delta z$ and the corresponding frequency change $\Delta f(z_i)$ for each of the possible tuner positions $z_i$, i.e. within the tuned bandwidth $[f_{min};f_{max}]$. However, for certain cases in might also be conceivable to have an almost linear frequency curve that comprises a larger slope for tuner frequencies only within a certain range $[z_3;z_3+\Delta z]$ of tuner positions within the resonator, e.g. in order to provide an increased sensitivity to frequency changes for that specific range. An example of such a curve 103 is shown in FIG. 10*b*. This is achieved by means of a tuner and/or resonator that comprises one or more sections 911 that are distinct either by means of their geometrical dimensions or the dielectric coefficient $\in_r$ of the applied material and arranged at those positions of the tuner and/or resonator that they become effective for a desired frequency sub-range $\Delta f(z_3)$. If the intended non-uniformity shall be achieved, e.g., by means of a modification of the tuner 91, which is shown for instance in FIG. 9, the modified tuner section 911 must be placed approximately such that it is protruded out of the resonator hollowness 92 for the range of tuner positions $[z_3;z_3+\Delta z]$ that correspond to the frequency range $\Delta f(z_3)$ for which the sensitivity shall be modified. The tuner can be generally composed of a larger number of such distinct sections, whereby the non-uniformity of the dielectric properties along the z-axis is achieved by means of different tuner proportions or materials comprising different dielectric permittivities $\in_r$. Correspondingly, if the intended non-uniformity shall be achieved by means of a resonator modification, the modified resonator section must be approximately placed such that the tuner is protruded out of this section for the range of tuner positions that correspond to the frequency range for which the sensitivity shall be modified.

The frequency curve 102, as shown in FIG. 10*a*, is achieved from the curve 101 for a tuning arrangement according to the state of the art by means of increasing the sensitivity for frequency changes $\Delta f(z_1)$ for tuner positions close to $z=z_{min}$ due to the fact that the sections having the largest mass and/or dielectric coefficient, i.e. in general the largest effective dielectric permittivity per unit length, are effective, i.e. protruded from the resonator hollowness, for said tuner positions. The sensitivity of the curve 102 decreases, when compared to curve 101, for positions where the tuner is protruded out of the resonator i.e. for tuner positions close to $z=z_{max}$.

For the frequency curve 103, as shown in FIG. 10*b*, the sensitivity to a change $\Delta z$ of the tuner position is increased for a specific range $[z_3;z_3+\Delta z]$ of tuner positions, which leads to a corresponding change $\Delta f(z_3)$ of the resonator frequency that is higher than it could be achieved by means of a tuning arrangement according to the state of the art as represented by the frequency curve 101.

The invention is not restricted to the embodiments that have been described above and have been shown in the drawings but can be modified within the scope of the accompanying claims.

The invention claimed is:

1. A tuner adapted to equalize non-linear frequency changes within a desired frequency range in response to tuner displacements relative to a resonator body, said tuner comprising:

a tuner element having a non-uniform distribution of the effective dielectric permittivity along an axis of tuner displacement, said non-uniform distribution of the effective dielectric permittivity is realised by subdividing the tuner element into a number of cross-sectional portions, each of which is distinguishable by their geometrical shape or size in the dimension perpendicular to said axis of tuner displacement or by a value or distribution of the dielectric coefficient $\in_r$ along said axis.

2. The tuner according to claim 1, wherein an effective tuning area is within a hollowness of the resonator.

3. The tuner according to claim 2, wherein cross-sectional portions includes two cylindrical sections comprising a ratio $d_1/d_2$ of section diameters within a range from 1.1 to 1.6 and a corresponding ratio $l_1/l_2$ of section lengths within a range from 0.2 to 0.4.

4. The tuner according to claim 2, wherein the cross-sectional portions includes two sections having a constant diameter having a ratio $\in_{r1}/\in_{r2}$ for the values of the dielectric coefficients of the sections within a range from 2.5 to 3.5 and a corresponding ratio $l_1/l_2$ for the section lengths within a range from 0.2 to 0.4.

5. The tuner according to claim 1, wherein an effective tuning area is outside of the resonator.

6. The tuner according to claim 5, wherein the cross-sectional portions includes two sections comprising a ratio $d_1/d_2$ for the section diameters within a range from 1.1 to 2 and a corresponding ratio $l_1/l_2$ for the section lengths within a range from 1.2 to 2.8.

7. The tuner according to claim 5, wherein the cross-sectional portions includes two sections having a constant diameter comprising a ratio $\in_{r1}/\in_{r2}$ for the values of the dielectric coefficients of the sections within a range from 1.2 to 4 and a corresponding ratio $l_1/l_2$ for the section lengths within a range from 1.2 to 2.8.

8. The tuner according to claim 1, wherein the tuner is equipped with a hollowness for fastening of an axis.

9. The tuner according to claim 8, wherein the axis of tuner displacement is arranged centrally through the resonator hollowness.

10. A tuner adapted to equalize non-linear frequency changes within a desired frequency range in response to tuner displacements relative to a resonator body, wherein the resonator comprises a non-uniform distribution of the effective dielectric permittivity along the axis of tuner displacement, wherein the non-uniform distribution of the effective dielectric permittivity is realised by subdividing the resonator into a number of cross-sectional portions along said axis of tuner displacement, each of which is distinguishable by at least their geometrical shape or size or the value and distribution of the dielectric coefficient $\in_r$ along said axis.

11. The tuner according to claim 10, wherein the cross-sectional portions perpendicular to said axis of tuner displacement comprise two sections having a constant dielectric coefficient comprising a ratio $d_1/d_2$ of the diameters of the hollowness in each section within a range from 1.1 to 2.0 and a corresponding ratio $l_1/l_2$ of the section lengths within a range from 1.5 to 4.5.

12. The tuner according to claim 10, wherein the cross-sectional portions perpendicular to said axis of tuner displacement comprise two sections having a constant diameter, a ratio $\in_{r1}/\in_{r2}$ for the values of the dielectric coefficients of the sections within a range from 1.4 to 4 and a corresponding ratio $l_1/l_2$ for the section lengths within a range from 1.5 to 4.5.

* * * * *